US005300411A

United States Patent [19]

Sterman et al.

[11] Patent Number: 5,300,411

[45] Date of Patent: Apr. 5, 1994

[54] PHOTOGRAPHIC LIGHT-SENSITIVE ELEMENTS

[75] Inventors: Melvin D. Sterman, Pittsford; Alfred B. Fant, Rochester; Melvin M. Kestner, Hilton; Dennis E. Smith; Gary W. Visconte, both of Rochester, all of N.Y.

[73] Assignee: Eastman Kodak Company, Rochester, N.Y.

[21] Appl. No.: 968,714

[22] Filed: Oct. 30, 1992

[51] Int. Cl.[5] ..... G03C 1/00

[52] U.S. Cl. ..... 430/496; 430/523; 430/536; 430/537; 430/539; 430/628; 430/950; 430/961

[58] Field of Search ..... 430/496, 523, 536, 537, 430/539, 628, 950, 961

[56] References Cited

U.S. PATENT DOCUMENTS

| | | | |
|---|---|---|---|
| 3,206,312 | 9/1965 | Sterman et al. | 430/529 |
| 3,428,451 | 2/1969 | Trevoy | 430/63 |
| 3,614,972 | 10/1971 | Gorter | 152/246 |
| 4,161,407 | 7/1979 | Campbell | 430/621 |
| 4,172,731 | 10/1979 | Heigold et al. | 430/510 |
| 4,203,769 | 5/1980 | Guestaux | 430/631 |
| 4,232,117 | 11/1980 | Naoi et al. | 430/539 |
| 4,264,707 | 4/1981 | Uozumi et al. | 430/275 |
| 4,275,103 | 6/1981 | Tsubusaki et al. | 430/67 |
| 4,394,441 | 7/1983 | Kawaguchi et al. | 430/524 |
| 4,495,276 | 1/1985 | Takimoto et al. | 430/527 |
| 4,855,219 | 8/1989 | Bagchi et al. | 430/523 |
| 4,856,219 | 8/1989 | Severance et al. | 43/17.5 |
| 4,885,219 | 12/1989 | Miller | 429/96 |
| 4,914,012 | 4/1990 | Kawai | 430/536 |
| 4,920,004 | 4/1990 | Bagchi | 430/523 |
| 4,975,363 | 12/1990 | Cavallo et al. | 430/637 |
| 4,977,071 | 12/1990 | Kanetake et al. | 430/537 |
| 4,980,267 | 12/1990 | Taber | 430/382 |
| 4,999,276 | 3/1991 | Kuwabara et al. | 430/264 |
| 5,057,407 | 10/1991 | Okamura et al. | 430/531 |
| 5,085,981 | 2/1992 | Himmelmann et al. | 430/523 |

OTHER PUBLICATIONS

*Research Disclosure* 17643, Dec. 1978.
*Research Disclosure* 22534 Jan. 1983.

*Primary Examiner*—Charles L. Bowers, Jr.
*Assistant Examiner*—Thomas R. Neville
*Attorney, Agent, or Firm*—Robert A. Gerlach

[57] ABSTRACT

Photographic elements having at least one layer containing polymeric matte particles covalently bonded to gelatin and colloidal silica.

12 Claims, No Drawings

PHOTOGRAPHIC LIGHT-SENSITIVE ELEMENTS

BACKGROUND OF THE INVENTION

Field of the Invention

This invention relates to silver halide photographic light-sensitive elements and more particularly to a method of forming images wherein the silver halide photographic light-sensitive element contains a matting agent in its outer most layer.

Finely divided materials with a mean particle size of from about 1 to about 10 micrometers are commonly used as matting agents to provide a rough surface to photographic elements. Modern day photographic film processing apparatus cause a problem in that contact with the film surface in these devices cause matte particles to separate from the film resulting in disadvantages to the image on the film as well as complication due to the presence of the matte particles in the processing solutions. U.S. Pat. Nos. 4,856,219; 4,920,004 and 5,057,407 provide matte particles and techniques to increase the adhesion of the particles to the photographic element during processing of the element. However, in addition, improvement in adhesion is still desirable. Printer dusting is also an objectionable problem associated with inadequate matte adhesion.

Colloidal silica in conjunction with various types of matte is disclosed in U.S. Pat. Nos. 4,975,363; 4,914,012; and 4,232,117.

SUMMARY OF THE INVENTION

The invention contemplates a photographic element having at least one light-sensitive layer on a support, the light-sensitive element containing a layer containing a first particulate material and a second particulate material the first particulate material being polymer matte particles covalently bonded to the gelatin in the layer and the second particulate material, being colloidal silica. The matte particles or beads in accordance with this invention can be included in any layer of the photographic element, but preferably are included in the top-most surface of a light-sensitive silver halide photographic element, in a separate layer over the top surface of the photographic element or in a layer in close proximity to the top-most layer so that the matte particles protrude above the surface of the top-most or outermost layer. The polymeric matte particles have a mean diameter ranging from about 0.5 to about 10 preferably from about 0.5 to about 5 micrometers and most preferably from about 1 to about 3.5 micrometers. The colloidal silica employed as the second particulate material has a particle diameter less than 50 nm and preferably from about 10 to about 25 nm.

Photographic elements in accordance with this invention demonstrate processing characteristics in modern rapid development apparatus with respect to matte adhesion, printer dusting, lack of haze and improved back side abrasion.

DETAILED DESCRIPTION OF THE INVENTION

Polymer particles useful in the present invention include any polymer that is capable of covalently bonding with gelatin, either directly or with the aid of a cross-linking agent.

Monomers, the polymers or copolymers of which covalently bond with gelatin directly, include monomers with an active halogen atom such as vinylchloroacetate, vinyl halogenated aromatics (e.g., chloromethylstyrene), chloroalkyl acrylic or methacrylic esters (e.g., chloroethylmethacrylate, 3-chloro-2-hydroxypropylmethacrylate, or chloroethylacrylate), isocyanates (e.g., isocyanatoethyl acrylate, isocyanatoethyl methacrylate, or $\alpha,\alpha$-dimethylmetaisopropenylbenzyl isocyanate), epoxides (e.g., glycidyl acrylate or glycidyl methacrylate), and compounds containing aldehyde groups (e.g., vinyl benzaldehyde and acrolein), and monomers containing chloroethylsulfone groups or vinyl sulfone groups (e.g., chloroethylsulfonlymethylstyrene and vinlysulfonylmethylstyrene), as described in U.S. Pat. No. 4,161,407 issued to Campbell. Monomers, the polymers and copolymers of which are capable of covalently bonding with gelatin through the use of a cross-linking agent, include carboxylic acids (e.g., acrylic acid, methacrylic acid, itaconic acid, and maleic acid or anhydride), amine-containing monomers (e.g., 2-aminoethyl methacrylate and N-(3-aminopropyl) methacrylamide hydrochloride), and active methylene group-containing monomers (e.g., 2-acetoacetoxyethyl methacrylate and diacetone acrylamide). Monomers having functional groups capable of forming a covalent bond by reacting with an organic hardener or a binder such as gelatin as disclosed in U.S. Pat. 5,057,407 (incorporated herein by reference) can also be used.

Polymers useful in the invention preferably comprise at least 0.1 mole percent or more preferably at least 1 mole percent of monomers, the polymers or copolymers of which are capable of covalently bonding with gelatin, either directly or with the aid of a cross-linking agent.

In one embodiment of the invention, the polymer useful in the present invention is represented by the formula:

$$--A_x(--B--)100_{-x}$$

wherein A represents recurring units derived from one or more of the monomers described above that are capable of covalently bonding with gelatin, and B represents recurring units derived from one or more other ethylenically unsaturated monomers.

Monomers represented by B include essentially any monomer capable of copolymerizing with the above-described monomers without rendering them incapable of covalently bonding with gelatin. Examples of such monomers include ethylenically unsaturated monomers such as styrene and styrene derivatives (e.g., vinyltoluene, vinylbenzene, divinylbenzene, 4-*t*-butylstyrene, and 2-chloromethylstyrene) and acrylic and methacrylic acid esters (e.g., methyl methacrylate, methyl acrylate, ethyl methacrylate, n-butyl acrylate, 2-ethylhexyl methacrylate, 2-hydroxyethyl methacrylate, 2-hydroxyethyl acrylate, ethylene dimethacrylate, methacrylamide, and acrylonitrile). In such a copolymer, the amount of copolymers that are capable of covalently bonding with gelatin should be sufficient to bind a contiguous layer of gelatin to the surface of the polymer particle.

In the above formula, x represents from 0.1 to 100 mole percent and preferably from 1 to 20 mole percent.

Polymer particles useful in the present invention can be of essentially any shape. Useful particles will generally have a mean diameter in the range of 0.5 to 10 microns. Especially preferred are particles having a mean diameter of from 1 to 3.5 microns. Mean diameter is defined as the mean of the volume distribution. In some embodiments of the invention, it is preferable to have polymer particles that are in the form of spherical beads having diameters in the size ranges described above.

The gelatin to be covalently bound to the polymer particles can be any of the types of gelatin known in the photographic art. These include, for example, alkali-treated gelatin (cattle bone or hide gelatin), acid-treated gelatin (pigskin or bone gelatin), and gelatin derivatives such as partially phthalated gelatin, acetylated gelatin, and the like. The gelatin may be hardened, as is known in the art. The gelatin covalently bound to the polymer particles may be cross-linked through the use of a conventional cross-linking agent, which also serves to harden the gelatin-containing layers of the element.

The polymer particles can be prepared by techniques well-known in the art, such as by polymerization followed by grinding or milling to obtain the desired particle size, or more preferably by emulsion or suspension polymerization procedures whereby the desired particle size can be produced directly as stable dispersions. Emulsion polymerization techniques can be employed to produce particle sizes ranging from about 0.01 to 5 μm (preferably about 0.1 to 2.5 μm) as stable aqueous dispersions that can be coated directly without isolation. Larger size particles, i.e., over about 3μm are preferably prepared by suspension polymerization, often in an organic solvent system from which the particles are isolated and resuspended in water for most economic coating procedures, or most preferably by "limited coalescence" procedures, taught by U.S. Pat. No. 3,614,972. The bulk, emulsion, and suspension polymerization procedures are well-known to those skilled in the polymer art and are taught in such text books as W.P. Sorenson and T.W. Campbell, *Preparation Methods of Polymer Chemistry,* 2nd ed., Wiley (1968) and M.P. Stevens, *Polymer Chemistry—An Introduction,* Addison Wesley Publishing Co. (1975).

In a preferred embodiment, polymer particles having gelatin covalently bonded thereto (or gel-grafted polymer particles ) are utilized as a matting agent in photographic elements. The gelatin that is covalently bonded to the particles is covalently bonded (i.e., cross-linked) with the gelatin in a layer of the photographic element. The polymer core provides the particles with the necessary size, hardness, and inertness to effectively function as matting agents while the gelatin shell allows the particles to be cross-linked with gelatin layers in the element so that they are not washed off during processing.

The polymer particles, if the polymer is of the type as described above that is capable of bonding directly with gelatin, may be covalently bonded with gelatin simply by contacting the particles with gelatin under conditions as described below. If the polymer is of the type that utilizes a cross-linking agent to bond with gelatin, the polymer particles are preferably first contacted with the cross-linking agent and then with gelatin, so as that the gelatin preferentially reacts with the polymer particles, instead of gelatin-gelatin cross-linking. Carbamoyl pyridinium cross-linking agents are advantageously utilized in the practice of this invention because they tend to first bond to a carboxyl group on a polymer particle and then with an amino group on the gelatin molecule.

To prepare gel-grafted polymer particles, the contacting of the polymer particles and gelatin is preferably performed in an aqueous dispersion of the particles. The concentration of polymer particles in the aqueous dispersion is preferably less than about 25% and more preferably less than about 15% by weight. The concentration of gelatin in the aqueous dispersion is preferably less than about 25% and more preferably less than about 15% by weight.

The pH of the aqueous dispersion and the concentration of the particles and gelatin should be adjusted to prevent bridging of gelatin molecules between polymer particles. The pH of the gelatin is preferably maintained above the isoelectric pH of the gelatin (e.g., above 5.8 and preferably between 8 and 10 for lime-processed bone gelatin). Under such conditions, both the particles and the gelatin should have the same charge, preferably negative, in order to minimize coagulation.

Polymer particles useful in the invention can be located any place in the photographic element where there is gelatin with which the gelatin covalently bound to the particle can cross-link, and where it is desirable to have a matting agent. The particles can be incorporated in an overcoat layer, that is, the outermost layer of the photographic element, or they can be incorporated in an underlying layer such as, an emulsion layer, or an interlayer, as long as the particle sizes and layer thicknesses are such that the matting agent performs its function of imparting roughness to the surface of the element. Elements containing matting agents are described in further detail in U.S. Pat. No. 4,172,731 and *Research Disclosure* 17643, December, 1978.

In a preferred embodiment of the invention, the polymer particles are utilized as a matting agent on the outermost surface of a photographic element.

In a preferred embodiment of the invention, a photographic element is prepared by coating a gelatin-containing layer onto a support, at least partially drying the layer, applying polymer particles to the surface of the layer, and covalently bonding the polymer particles to the gelatin in the layer.

According to another preferred embodiment of the invention, the photographic element includes a support having thereon a gelatin-containing layer, which may be, for example, a silver halide emulsion layer. Polymer particle having gelatin covalently bonded thereto are positioned on top of layer. The gelatin is cross-linked with the gelatin in layer.

In a preferred embodiment of the invention, a photographic element such as the one described is prepared by coating the gelatin-containing layer onto a support, at least partially drying the layer, applying gel-grafted polymer particles to the surface of the layer, and hardening the gelatin in the layer so as to cause cross-linking between the gelatin in the layer and the gelatin covalently bonded to the polymer particles.

The gelatin-containing layer and other layers in the element may be coated by any of the known coating methods, such as curtain coating, roller coating, bead coating, doctor blade coating, gravure coating, reverse gravure coating, and the like. The layer is generally dried by simple evaporation, which may be accelerated by known techniques such as convection heating. Known coating and drying methods are described in more detail in the above-referenced *Research Disclosure* 17643. The polymer particles can be applied by a variety of methods, such as with an air jet or simply dropped onto the surface of the gelatin-containing layer. In such cases it may be desirable for the gelatin-containing layer to have been dried sufficiently to prevent invasion of the emulsion layer by the particles during subsequent drying, but left still somewhat tacky so as to prevent the particles from being dislocated before the gelatin covalently bonded to them cross-links with the gelatin in the layer.

A preferred method of applying the polymer particles to the gelatin-containing layer is to coat a dispersion of the particles in a liquid medium such as an organic solvent or water, which may optionally contain a small amount of gelatin (e.g., on the order of the same weight concentration as the polymer particles, preferably less than about 25%, based on total weight of the dispersion), onto the gelatin-containing layer. Such a coating dispersion would generally have a weight ratio of polymer particles to liquid of between 1:99 and 5:95.

The cross-linking of the gelatin in the gelatin-containing layer and the gelatin that is covalently bound to the polymer particles may be carried out with any of the compounds known to cross-link, or harden, gelatin. These include, for example, free dialdehydes such as succinaldehyde, blocked dialdehydes, sulfonate esters, active esters, epoxides, aziridines, blocked active olefins, carbodiimides, carbamoylpyridiniums, vinyl sulfones, polymeric hardeners such as dialdehyde starches or poly(acroleinmethacrylic acid), and many others. The cross-linking is generally carried out by simply applying solutions of these hardeners to the photographic element.

The cross-linking compound can be applied to either the particles or the gelatin-containing layer before the particles are contacted with the layer if such contacting is done while there is still enough residual cross-linking compound present to cross-link the gelatin in the layer to the gelatin on the particles when they are brought into contact. Alternatively, the cross-linking compound can be applied after the particles are brought into contact with the gelatin-containing layer. Further disclosure of cross-linking hardeners is given in the above-referenced *Research Disclosure* 17643.

Photographic elements according to the invention generally comprise at least one light-sensitive layer, such as a silver halide emulsion layer. This layer may be sensitized to a particular spectrum of radiation with, for example, a sensitizing dye, as is known in the art. Additional light-sensitive layers may be sensitized to other portions of the spectrum. The light-sensitive layers may contain or have associated therewith dye-forming compounds or couplers. For example, a red-sensitive emulsion would generally have a cyan coupler associated therewith, a green-sensitive emulsion would be associated with a magenta coupler, and a blue-sensitive emulsion would be associated with a yellow coupler. Other layers and addenda, such as antistatic compositions, subbing layers, surfactants, filter dyes, protective layers, barrier layers, development inhibiting releasing compounds, and the like can be present in photographic elements of the invention, as is well-known in the art. Detailed description of photographic elements and their various layers and addenda can be found in the above-identified *Research Disclosure* 17643 and in James, *The Theory of the Photographic Process*, 4th, 1977.

In addition to the above, the matte particles covalently bonded to gelatin taught in U.S. Pat. Nos. 4,855,219; 4,920,004 and 5,057,407 (the total disclosures of which are completely incorporated herein by reference) may be used in the practice of this invention.

The second particulate material present in the photographic element in accordance with this invention is colloidal silica. Colloidal silica particles are small, discrete and uniformly dispersed in water alkaline media which reacts with the silica surface to produce a negative charge on the particles that repel each other to make up a stable water dispersion. A suitable dispersion is one sold under the trade designation Ludox by DuPont Co. Because the matte particles are covalently bonded to the gelatin of the layer, the further improvement in adhesion by combining such particles with colloidal silica particles as a second particulate material in the layer is quite unexpected.

In this invention, the matting agent is generally incorporated into the outermost layer of a light sensitive material, however, as indicated above, the matting agent can be incorporated into any layer of the light sensitive element. By outermost layer is meant either the emulsion side surface protecting layer or a backing layer or both. However, it is particularly preferable to allow to incorporate the matting agent in the surface protecting layer.

Another advantage of this invention is that equipment such as, dissolution tanks and the like used in the process of production are washed with ease because the matting agent does not adhere firmly to the wall surfaces.

The matting agent is employed in an amount to achieve a coverage of from about 2 to about 500 mg per square meter. The matte particle content should range from 0.3 to 25 weight percent of the gelatin content of the layer and preferably from about 0.6 to 18.5 weight percent. The colloidal silica preferably should be employed in an amount up to about 50 weight percent based on the gelatin content of the layer and preferably in an amount of from about 5 to about 40% by weight.

As for gelatin, any kinds of gelatin, for example, alkali-processed gelatin, acid-processed gelatin, enzyme-processed gelatin, gelatin derivatives and denatured gelatins, are usable.

Further, the outermost layer of this invention may optionally contain a hardening agent, a smoothing agent, a surface active agent, an antistatic agent, a thickener, polymers, an ultraviolet ray absorbent, a high boiling point solvent, silver halides, a formalin capturing agent, a polymer latex and various other additives.

Examples of a hardening agent employable in this invention includes aldehyde series compounds, active halogen-containing compounds such as 2-hydroxy-4,6-dichloro-1,3,5-triazine, vinyl sulfone series compounds, N-methylol series compounds, halogencarboxyaldehyde compounds such as mucochloric acid, and so on.

As a surface active agent, any kind of surface active agents, for example, natural surface active agents such as saponin, nonionic surface active agents such as polyalkyleneoxide; cationic surface active agents such as higher alkylamines, quaternary ammonium salts and so on; anionic surface active agents containing acidic groups such as carboxylic acid, sulfonic acid and so forth may be used.

As an antistatic agent, the outermost layer may contain surface active agents as described above, alkali metal salts of styrene-maleic acid series copolymers and acrylonitrile-acrylic acid series copolymers, and antistatic agents as described in U.S. Pat. Nos. 3,206,312; 3,428,451; metal oxides, such as $V_2O_5$, $SnO_2$, $ZnO_2$, $TiO_2$, antimony doped $SnO_2$ and the like. Suitable metal oxides are set forth in U.S. Pat. Nos. 4,203,769; 4,264,707; 4,275,103; 4,394,441; 4,495,276, 4,999,276 and so forth.

Photographic elements in which the particles of the invention can be utilized generally comprise at least one light-sensitive layer, such as a silver halide emulsion layer. This layer may be sensitized to a particular spectrum of radiation with, for example, a sensitizing dye, as is known in the art. Additional light-sensitive layers may be sensitized to other portions of the spectrum. The light sensitive layers may contain or have associated therewith dye-forming compounds or couplers. For example, a red-sensitive emulsion would generally have a cyan coupler associated therewith, a green-sensitive emulsion would be associated with a magenta coupler, and a blue-sensitive emulsion would be associated with a yellow coupler. Other layers and addenda, such as antistatic compositions, subbing layers, surfactants, filter dyes, protective layers, barrier layers, development inhibiting releasing compounds, and the like can be present in photographic elements of the invention, as is well-known in the art. Detailed description of photographic elements and their various layers and addenda can be found in the above-identified *Research Disclosure* 17643 and in James, *The Theory of the Photographic Process,* 4th, 1977.

Photographic elements suitable for use in combination with the overcoat layer containing matte particles in accordance with this invention are disclosed in *Research Disclosure* 22534, January 1983, which is incorporated herein by reference. Further, the light sensitive elements disclosed in U.S. Pat. No. 4,980,267, fully incorporated herein by reference, are particularly applicable to protection by the overcoat layers in accordance with this invention.

It is, at times, desirable to include in the layer containing the matte particles in accordance with this invention, an amount of polymeric emulsion polymerized latex particles to improve adhesion during processing. Suitable polymeric latex particles have a diameter of from about 0.01 to 0.5 μm, preferably from about 0.02 to about 0.1 μm and are employed in an amount of from about 10 to about 75 weight percent, preferably from about 25 to about 50 percent by weight based on the weight of the gelatin present in the layer. Suitable monomers for use in the preparation of latex homopolymers or copolymers include, for example, methyl acrylate, methyl methacrylate, 2-acrylamido-2-methyl propane sulfonic acid, styrene, butyl methacrylate, 2-methacryloyloxyethyl-1-sulfonic acid-sodium salt, vinylidene chloride, itaconic acid, acrylonitrile, acrylic acid, n-butyl acrylate, 2-[N,N,N-trimethyl ammonium] ethyl methacrylate methosulfate and the like. Particularly, suitable copolymers include polymethyl acrylate-co-2-acrylmido-2-methylpropane sulfonic acid (96:4), styrene-cobutylmethacrylate-co-2-methacryloyloxy-ethyl-1-sulfonic acid-sodium salt, methyl acrylate-co-vinylidene chloride-co-itaconic acid, acrylonitrile-co-vinylidene chloride-co-acrylic acid, n-butyl acrylate-co-methylmethacrylate, acrylonitrile-co-vinylidene chloride-co-2[N,N,N,-bimethyl ammonium] ethyl methacrylate methosulfate and the like.

It is also, at times, desirable to employ as the polymer for the matte particles one that has a refractive index that closely matches that of the binder for the layer containing the particles. For example, if gelatin is the binder, a polymer or copolymer having a refractive index as close to 1.54, as possible, will result in improved light transmission of the layer and thus improved characteristics for the photographic element.

The invention is further illustrated by the following examples:

EXAMPLE 1 PREPARATION OF POLYMERIC PARTICLES

Vinyl toluene, Vt, (38 kg) and chloromethyl styrene, Cs, (2kg) are mixed in a reactor. 100 gms of Aerosol-OT surfactant (American Cyanamide) and then 560 gms of 2,2'-azobis(2-methylpropionitrile) (Akzo) are added and dissolved in the monomer mixture. Next 127.5 kg of demineralized water are added, followed by 600 gms of Triton X100 surfactant (Rohm and Haas). After the mixture is stirred for 30 minutes, 15 psi of nitrogen pressure is used to pass the mixture through a Gaulin Mill operating at 2400 rpm, a 0.004 inch gap and a flow rate of 1 gallon per minute. The reactor temperature is raised to 70 degrees C and the reaction carried out over a twenty hour time interval. After unreacted monomers are removed by evaporation, the reactor mixture is cooled to 20 degrees C and filtered through a cartridge filter. The bead suspension has a solids content of 23.7% by weight and the residual monomer content is 0.14% vinyl toluene and 0.08% chloromethyl styrene. The nominal volume average bead size is 2.7 microns.

EXAMPLE 2 COVALENT BINDING OF GELATIN TO THE PARTICLES 2797 gms of the suspension of polymer beads from the previous procedure and 1492 gms of distilled water are placed in a 12 liter three neck flask fitted with a stirrer and a condenser. The suspension is heated to 60 degrees C and the pH is adjusted to 8.0. In a second flask 643 gms of a lime processed bone gelatin which consists of 50% gelatin are added to 1929 gms of distilled water. The gelatin mixture is heated to 60 degrees C and when complete solution of the gelatin is achieved the pH is adjusted to 8.0. The gelatin solution is then added to the flask containing the polymer bead suspension, and the mixture is stirred for four hours, during which time the temperature is maintained at 60 degrees C. The flask is then removed from the constant temperature bath and the contents of the flask are filtered through a cheese cloth bag. Analysis of the suspension of gelatin-grafted-polymer beads yields a solids content of 13.74% by weight and a pH of 7.48.

EXAMPLE 3 PHOTOGRAPHIC ELEMENTS

A series of color photographic elements are prepared as follows:

A cellulose triacetate film support having an antihalation layer on one side and an antistatic layer on the other is coated on the antihalation layer with the following layers in sequence (coverages are in grams per meter squared):

SLOW CYAN DYE-FORMING LAYER

This layer comprises a blend of red-sensitized, cubic, silver bromoiodide emulsion (1.5 mol percent iodide) (0.31 μm grain size) (1.16 g/m$^2$) and sensitized, tabular grain, silver bromoiodide emulsion (3 mol percent iodide) (0.75 μm diameter by 0.14 μm thick) (1.31), Compound J (0.965), Compound F (0.011), Compound L (0.65) and gelatin (2.96 g/m$^2$).

FAST CYAN DYE-FORMING LAYER

This layer comprises a red-sensitized, tabular grain silver bromoiodide emulsion (6 mol percent iodide) having a diameter of 1.40 μm and a thickness of 0.12 μm (0.807), Compound J (0.102), Compound K (0.065), Compound L (0.102) and gelatin (1.506).

INTERLAYER

This layer comprises Compound F (0.054), an antifoggant and gelatin (1.291).

SLOW MAGENTA DYE-FORMING LAYER

This layer comprises a blend of green-sensitized tabular grain silver bromoiodide emulsion (3 mol percent iodide) (grain diameter 0.55 um and thickness 0.08 um) (0.473) and tabular grain silver bromoiodide emulsion (3 mol percent iodide) (grain diameter 0.52 and thickness 0.09 um) (0.495), Compound G (0.161), Compound I (0.108) and gelatin (2.916).

FAST MAGENTA DYE-FORMING LAYER

This layer oomprises a blend of green-sensitized tabular grain silver bromoiodide emulsion (3 mol percent iodide) (grain diameter 1.05 μm and thickness 0.12 μm) (0.536) and tabular grain silver bromoiodide emulsion (3 mol percent iodide) (grain diameter 0.75 μm and thickness 0.14 μm), Compound G (0.258), Compound H (0.054) and gelatin (1.119).

INTERLAYER

This layer comprises Carey-Lea Silver (0.43), Compound F (0.054), an antifoggant and gelatin (0.861).

SLOW YELLOW DYE-FORMING LAYER

This layer comprises a blend of blue-sensitized tabular grain silver bromoiodide emulsions (3 mol percent iodide) (grain diameter 0.57 μm and thickness 0.12 μm) (0.274) and blue-sensitive silver bromoiodide emulsion (0.3 mol percent iodide) (grain diameter 0.52 μm and thickness 0.09 μm) (0.118), Compound C (1.022), Compound D (0.168) and gelatin (1.732).

FAST YELLOW DYE-FORMING LAYER

This layer comprises a blue-sensitized tabular grain silver bromoiodide emulsion (3 mol percent iodide) (grain diameter 1.10 μm and thickness 0.12 μm) (0.43), Compound C (0.161), Compound D (0.054), Compound E (0.003) and gelatin (0.791).

UV ABSORBING LAYER

This layer comprises silver halide Lippmann emulsion (0.215), Compound A (0.108), Compound B (0.106) and gelatin (0.538).

OVERCOAT

This layer comprises matte particles of Example 1 (0.038) and gelatin (0.888)

The structures of the above-designated Compounds A through L are as follows:

A:

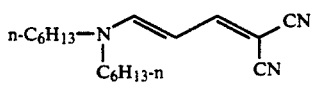

B:

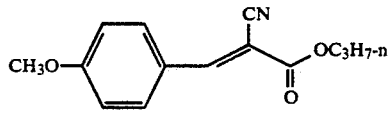

C:

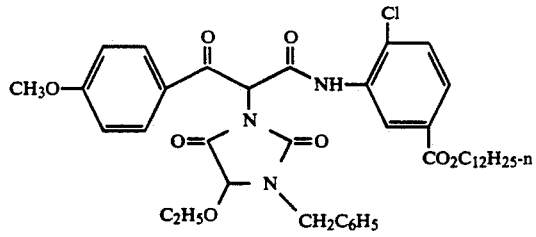

D:

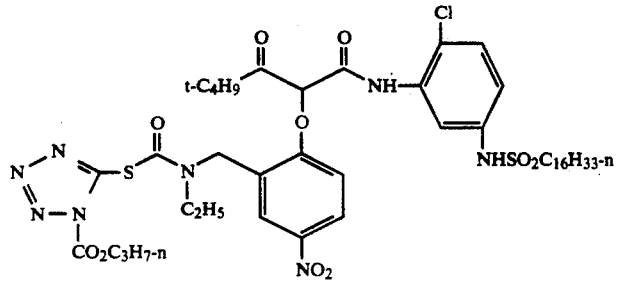

-continued
E:
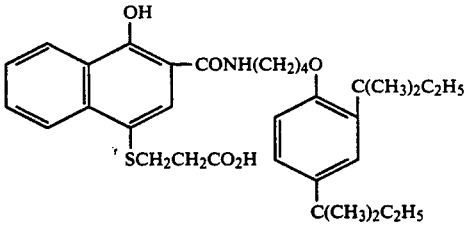
F:
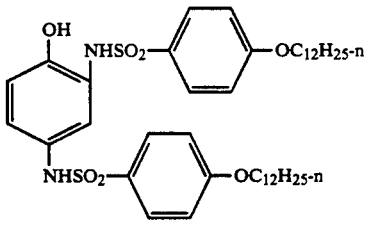
G:
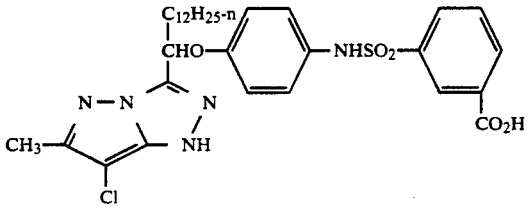
H:
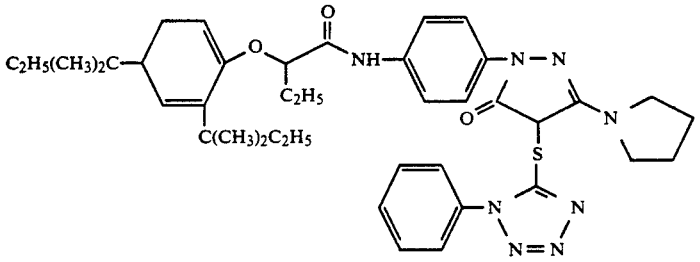
I:
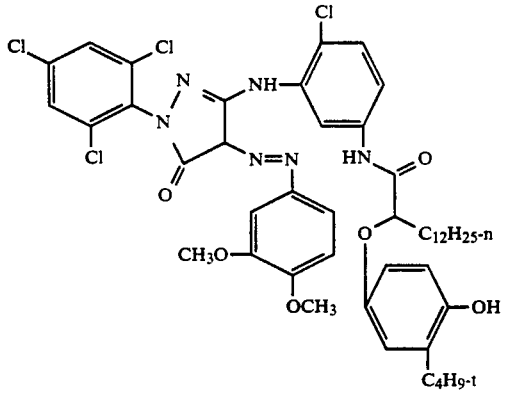
J:
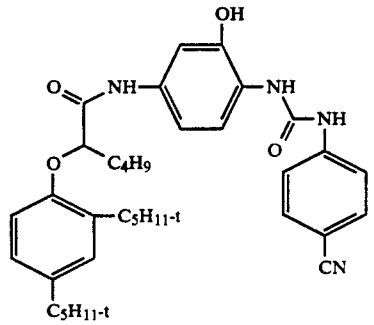

-continued

K:

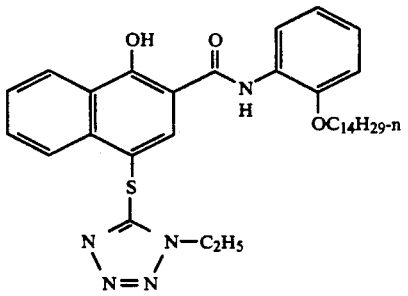

L:

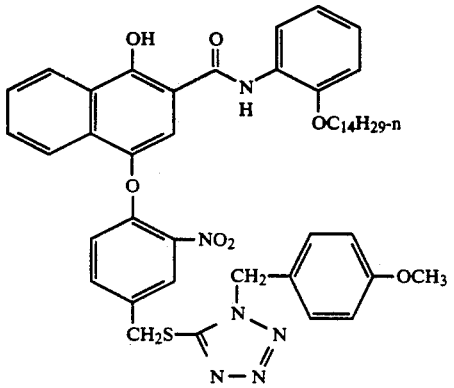

(A) (Control) The coating solution for the gelatin overcoat is prepared in the following manner:

In a mixing vessel combine 1179 grams of Type IV gelatin, as a swollen gelatin which contains 65% water, 1000 grams distilled water, 285.3 grams of a matte dispersion, which consists of 6.75% matte beads of Example 2, 7.5% Type IV gelatin, and the balance being distilled water, and 222 grams of a lubricant/gelatin dispersion which contains 9.0% Type IV gelatin.

This mixture is heated at 46C. with gentle stirring until the gelatin dissolves completely, approximately 30 minutes, and a uniform solution is achieved.

This solution is held at 46° C. and the following addenda are added in the following order:

| | |
|---|---|
| Sulfuric acid | 30 cc/pound gelatin |
| Alkanol XC | 13.6 cc/pound of gelatin |
| Surfactant 10G | 14.9 cc/pound of gelatin |
| Fluorad FC135 | 2.0 cc/pound gelatin |

This solution is then cooled to 40° C.; the pH adjusted to 5.5 with either a weak acid or base as needed and distilled water added to bring the total weight of the solution to 4761.0 grams.

This coating solution is applied to the photographic element described.

(B)(Invention) A solution is prepared as described in (A) except that in addition colloidal silica (Ludox AM, supplied by DuPont Co, particle size 12 nm) is added in an amount equal to 33 percent by weight of the gelatin content of the solution and is applied to the element in the same manner.

(C)(Control) A solution is prepared as described in (A) except that the poly(vinyl toluene/chloromethyl styrene) matte beads of Example 2 are replaced with poly(vinyl toluene/chloromethyl styrene) matte beads as prepared in Example 1. This solution is coated as indicated above.

(D)(Control) A solution is prepared and coated as described in (C) except that in addition colloidal silica (Ludox AM) is added in an amount equal to 33 weight percent of the gelatin content of the solution.

(E)(Invention) A solution is prepared and coated as described in (B) except that matte beads are replaced with poly(vinyl toluene-co-methyl methacrylate-co-chloromethyl styrene) (Vr Mm Cs) matte beads, wherein the Vt content is 30 weight percent, the Mm content is 60 weight percent, and the Cs content is 10 weight percent.

(F)(Invention) A solution is prepared and coated as described in (E) except that the monomer content of the matte beads is 40 weight percent Vt and 50 weight percent Mm and 10 weight percent Cs.

(G)(Invention) A solution is prepared and coated as described in (E) except that the matte beads monomer content of the matte beads is 45 weight percent Vt, 45 weight percent Mm and 10 weight percent Cs.

(H)(Invention) A solution is prepared and coated as described in (E) except that 8 weight percent Ludox AM based on the weight of the gelatin content of the solution is added to the coating solution.

(I)(Invention) A solution is prepared and coated as described in (F) except that 8 weight percent of Ludox AM based on the weight of the gelatin content of the solution is added to the coating solution.

(J)(Invention) A solution is prepared and coated as described in (G) except that 8 weight percent of Ludox AM based on the weight of the gelatin content of the solution is added to the coating solution.

EVALUATION METHODS

Equal footage of film from each of the experimental coatings is perforated for use in a 35 mm camera and exposed. These exposed films are then processed in a standard photofinishing processor with fresh stabilizer solution, which is the final solution in the process, to insure that the matte beads from previously processed films will not be deposited on the test film surface.

The processed films are then printed in a standard photofinishing high speed printer which has roller contact with the topmost protective layer of the film which contains the matte beads. Following the printing operation for each film sample, the roller is removed and analyzed for the number of matte beads that transfer to the roller, i.e., dusted from the film surface due to poor adhesion.

This test data demonstrates the very significant improvement in matte bead retention, or conversely, the reduction in matte bead loss observed with those film samples in which colloidal silica is present and the matte beads are covalently bonded to gelatin.

In an alternative method of analysis, following the printing operation, each of the processed films is evaluated for matte adhesion by examining the surface of each film sample with an optical microscope and counting the number of craters, or pits, on the surface which result from the removal of the matte beads during the processing, notching and printing operations. A constant surface area is used for each film sample in this procedure.

The films prepared in the above examples are evaluated for matte adhesion. A very significant improvement in matte bead retention is observed in those samples having colloidal silica present as an addendum where the matte beads are covalently bonded to gelatin.

The films are also evaluated for resistance to abrasion and scratching by the Taber Abrader test. This abrasion test is conducted on the processed emulsion using two wheels with a load of 185 grams for 100 cycles. The change in observed haze, i.e., the difference in haze of the test film observed before and after the abrader test indicates the degree of abrasion to the film sample. The degree of abrasion and scratching observed in the samples containing colloidal silica is much less than the layers containing gel grafted particles alone.

It is, of course, to be understood that like materials can be substituted throughout these examples without departing from the spirit and scope of this invention.

What is claimed:

1. A photographic element comprising at least one light-sensitive layer on a support said element containing in at least one layer, a first particulate matte material and a second particulate material, said first particulate material being polymeric particles bonded to gelatin and the second particulate material being colloidal silica having a particle size of less than 50 nm, said first particulate size of less than 50 nm, said first particulate matte material having a means particle size of from 1 to 5 micrometers.

2. The photographic element of claim 1 wherein the first particulate matte material has a mean particle size of from 1 to 3.5 micrometers.

3. The photographic element of claim 1 wherein the polymeric particles are included in the top-most layer.

4. The photographic element of claim 1 wherein the polymeric particles are included in an overcoat layer.

5. The photographic element of claim 1 wherein the layer containing the first particulate material and the second particulate material includes a gelatin binder.

6. The photographic element of claim 5 wherein the first particulate material is present in an amount of from about 0.3 to about 25 weight percent based on the weight of the gelatin.

7. The photographic element of claim 5 wherein the first particulate material is present in an amount of from about 0.6 to 18.5 percent by weight based on the weight of the gelatin.

8. The photographic element of claim 5 wherein the colloidal silica is present in an amount up to about 50 percent by weight, based on the weight of the gelatin.

9. The photographic element of claim 5 wherein the colloidal silica is present in an amount of from about 5 to about 40 percent based on the weight of the gelatin.

10. The photographic element of claim 1 wherein the layer containing the first and second particulate materials comprises gelatin and the polymeric particles are individually covered with gelatin that is covalently bonded thereto which is also covalently bonded to the gelatin of the layer.

11. A photographic element according to claim 1 wherein the polymer in said particles comprises an active halogen atom, an isocyanate group, an epoxide group, and aldehyde group, a chloroethylsulfone group, vinyl sulfone group, an amine group, a carboxylic acid group, or an active methylene group.

12. A photographic element according to claim 1 wherein the polymer particles comprise repeating units of the formula:

$$-A_x(-B-)_{100-x}$$

wherein

A represents recurring units derived from one or more monomers that are capable of covalently bonding with gelatin.

B represents recurring units derived from one or more other ethylenically unsaturated monomers, and X represents 0.1 to 100 mole percent.

* * * * *